US006746111B2

(12) United States Patent
Thielman et al.

(10) Patent No.: US 6,746,111 B2
(45) Date of Patent: Jun. 8, 2004

(54) LOW COST, HIGH AIR BARRIER INK SUPPLY

(75) Inventors: Jeffrey L. Thielman, Corvallis, OR (US); Rhonda L. Wilson, Monmouth, OR (US)

(73) Assignee: Hewlett-Packard Development Company, Houston, TX (US)

( * ) Notice: Subject to any disclaimer, the term of this patent is extended or adjusted under 35 U.S.C. 154(b) by 117 days.

(21) Appl. No.: 10/208,149

(22) Filed: Jul. 30, 2002

(65) Prior Publication Data

US 2004/0021747 A1 Feb. 5, 2004

(51) Int. Cl.[7] ..... B41J 1/75
(52) U.S. Cl. ..... 347/86
(58) Field of Search ..... 347/86, 85, 23, 347/19, 87, 29, 30, 84, 100, 95, 20, 71, 72

(56) References Cited

U.S. PATENT DOCUMENTS 5,801,735 A * 9/1998 Lorenze et al. ..... 347/85
5,975,686 A * 11/1999 Hauck et al. ..... 347/85
6,017,118 A 1/2000 Gasvoda et al.

FOREIGN PATENT DOCUMENTS

JP 60-125671 7/1985
JP 11-129489 5/1999

* cited by examiner

*Primary Examiner*—Stephen D. Meier
*Assistant Examiner*—Charles Stenart, Jr.

(57) ABSTRACT

An ink supply for a printing system is disclosed which provides a high barrier to air yet is inexpensive to produce. The ink supply includes a chassis having a first and second protrusion. An aperture extends through each of the protrusions to allow fluid communication with a bag; the bag is attached to the chassis so that at least a portion of the first protrusion is surrounded by the bag. Embodiments of the supply include least one air barrier insert, located in the aperture; a septum located in the air barrier; a film attached to the second protrusion and covering the aperture in the protrusion; and a shell which extends around at least a portion of the bag.

55 Claims, 7 Drawing Sheets

LOW COST, HIGH AIR BARRIER INK SUPPLY

BACKGROUND OF THE INVENTION

Inkjet printing systems frequently make use of printheads mounted to a carriage which is moved back and forth across a print media, such as paper. As the printhead is moved across the print media, control electronics activate an ejector portion of the printhead to eject, or jet, ink droplets from ejector nozzles and onto the print media to form images and characters. An ink supply provides ink replenishment for the printhead ejector portion.

Some printing systems make use of an ink supply that is replaceable separately from the printhead. When the ink supply is exhausted, the ink supply is removed and replaced with a new ink supply. The printhead is replaced at or near the end of the printhead life and not when the ink supply is exhausted. When a printhead is capable of reuse with a plurality of ink supplies, it is usually referred to as a "semipermanent" printhead. This is in contrast to a disposable printhead, that is replaced with each container of ink.

A significant issue with semipermanent printheads is the ability to keep air from entering the supply, especially over long periods of time. Air present in a printhead can interfere with the quality of the printing. Also, air negatively affects the ink printhead of the printer. By way of example only and not by way of limitation, air decreases the reliability of the printhead. In printheads that utilize a regulator to control the flow of ink into the printhead, an accumulation of air in the printhead will cause the printhead to fill up with air, thus resulting in a premature failure of the printhead.

Air accumulates during printhead life from a number of sources, including diffusion from the outside atmosphere into the ink supply. One solution to the air accumulation problem has been the use of disposable printheads. The geometry or size of an ink container associated with a printhead can be chosen to keep air accumulation below a critical threshold. When the amount of ink is small, this increases the cost of printing by requiring frequent printhead replacement. Alternatively, the ink container can be made larger to reduce the frequency of printhead replacement. However, large ink containers become problematic when the printing application is a compact desktop printer. An example of a system utilizing a disposable printhead, wherein a large ink supply is replaced each time the printhead is replaced, is described in U.S. Pat. No. 5,369,429.

Another solution to the air accumulation problem has been the use of air purge mechanisms to make semipermanent printheads viable. An example of an air purge approach is described in U.S. Pat. No. 6,152,559. Issues with purging systems include the added printer cost for the purge mechanism, the reliability problems associated with accommodating the ink that tends to be purged out with air, and the stranding of air in ink ejectors of the printhead, and an increase in maintenance requirements.

In short, there is a need for a low cost, high air barrier ink supply that is suitable for a desktop printer.

SUMMARY OF THE INVENTION

Briefly, the present invention comprises, in one embodiment, an ink supply for a printing system comprising a chassis with at least one aperture extending therethrough, a bag comprising material that is resistant to air diffusion, wherein the bag is attached to the chassis to allow ink communication from the bag through the aperture in the chassis, and at least one air barrier insert with an aperture therethrough positioned in the at least one aperture of the chassis.

In a further embodiment of the present invention, there is provided an ink supply for a printing system comprising a chassis, wherein the chassis comprises first and second protrusions, and wherein an aperture extends through each of the protrusions to allow fluid communication therethrough, a bag, wherein the bag is attached to the chassis so that at least a portion of the first protrusion is surrounded by the bag, at least one air barrier insert, wherein the air barrier insert is located in the aperture, a septum, wherein the septum is located in the air barrier, a film, wherein the film is attached to the second protrusion and covers the aperture in the protrusion, and, a shell, wherein the shell extends around at least a portion of the bag.

In a further embodiment of the present invention, there is provided a method of printing, comprising the steps of obtaining a printer utilizing a replaceable ink supply, wherein the ink supply comprises a chassis, wherein the chassis comprises a first and second protrusion, and wherein an aperture extends through each of the protrusions to allow fluid communication; a bag, wherein the bag is attached to the chassis so that at least a portion of the first protrusion is surrounded by the bag; at least one air barrier insert, wherein the air barrier insert is located in the aperture; a septum, wherein the septum is located in the air barrier; a film, wherein the film is attached to the second protrusion and covers the aperture in the protrusion; and a shell, wherein the shell extends around at least a portion of the bag; and printing from the printer.

In a further embodiment of the present invention, there is provided a printer, comprising an ink supply station comprising a needle, adapted to interface with a replaceable ink supply, wherein the ink supply comprises a chassis, wherein the chassis comprises first and second protrusions, and wherein an aperture extends through each of the protrusions to allow fluid communication therethrough; a bag, wherein the bag is attached to the chassis so that at least a portion of the first protrusion is surrounded by the bag; at least one air barrier insert, wherein the air barrier insert is located in the aperture; a septum, wherein the septum is located in the air barrier; a film, wherein the film is attached to the second protrusion and covers the aperture in the protrusion; and a shell, wherein the shell extends around at least a portion of the bag.

In a further embodiment of the present invention, there is provided a method of making ink supply comprising attaching a chassis to a bag for containing ink, wherein the chassis comprises a first and second protrusion, and wherein an aperture extends through each of the protrusions to allow fluid communication, and wherein the bag is attached to the chassis so that at least a portion of the first protrusion is surrounded by the bag; inserting at least one air barrier insert into the chassis, wherein the air barrier insert is inserted in the aperture; inserting a septum into the air barrier; attaching a film to the second protrusion so that the film covers the aperture in the protrusion; and attaching a shell to the chassis so that the shell extends around at least a portion of the bag.

DETAILED DESCRIPTION OF THE EMBODIMENTS

In the present invention, an ink supply is provided wherein measures are taken to prevent the ingress of air into the ink supply from the external environment. Moreover, the ink supply may hold ink that is not fully saturated (unsaturated ink), which provides the capability of absorbing some quantity of air within the printing system and therefore preventing or reducing the harmful buildup of air within the system. Also, the present invention in some embodiments allows the ink supply to be manufactured for a low cost and to be used in a small format (desktop) printer.

The various embodiments of the present invention may incorporate teachings of U.S. Pat. No. 6,017,118, which is incorporated by reference herein in its entirety. Additionally, the various embodiments of the present invention incorporate various teachings of U.S. patent application Ser. Nos. 09/758,744 and 09/758,746, both of which are incorporated herein by reference in their entirety.

Figure 1:
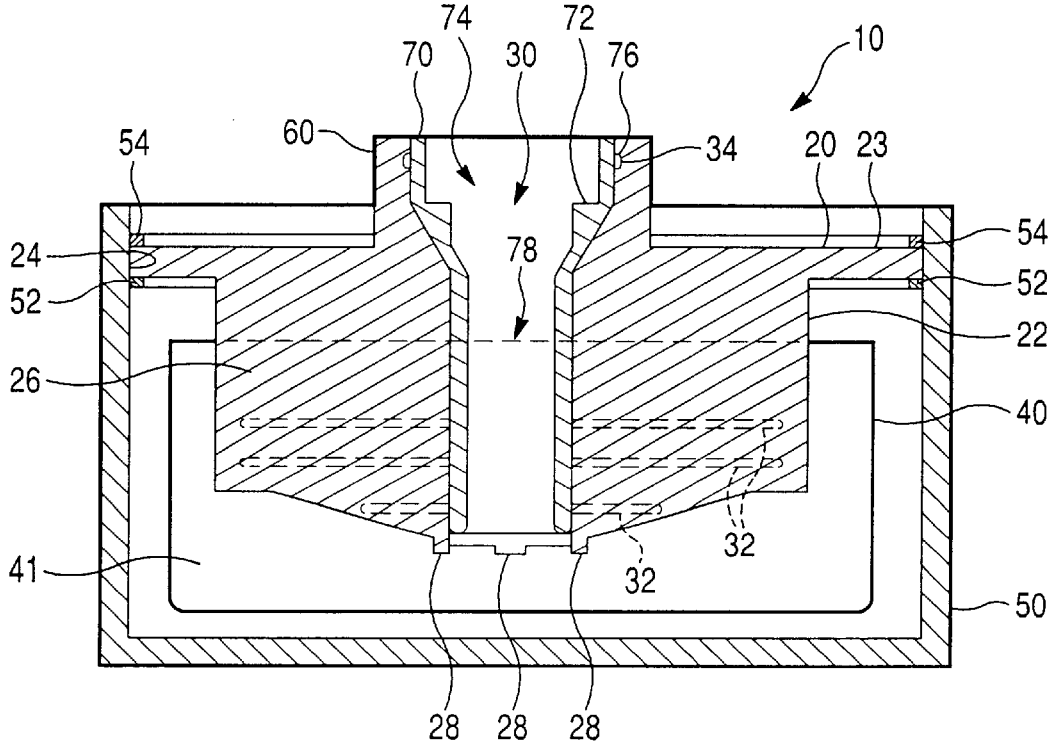
FIG. 1 is a schematic diagram of one embodiment of the ink supply of the present invention.
Figure 2:
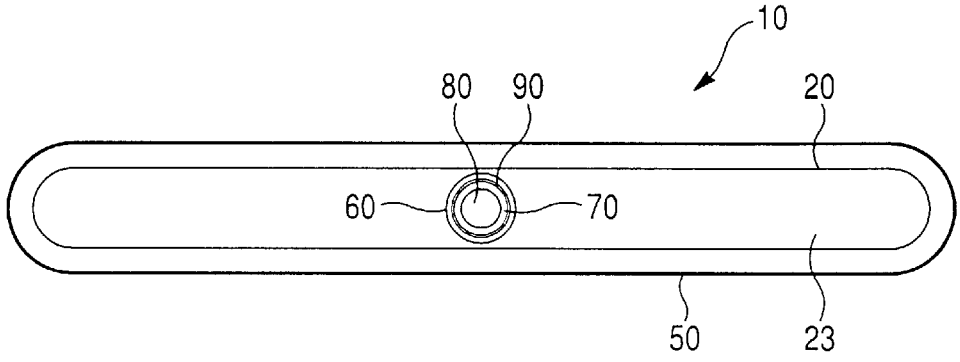
FIG. 2 is a top view of an embodiment of the ink supply of the present invention.

Referring to FIGS. 1 and 2, a first embodiment of the present invention is shown including an ink supply 10 for a printing system comprising in part a chassis 20 with at least one aperture 30 extending therethrough, a bag 40 comprising material that is resistant to air diffusion, wherein the bag 40 is attached to the chassis 20 to allow ink communication from the bag through the aperture in the chassis 20, and at least one air barrier insert 70 with an aperture therethrough positioned in the at least one aperture 30 of the chassis 20.

In one embodiment of the present invention, the bag 40 is attached to the chassis around a protrusion 22 (first protrusion) in the chassis in a manner such that the aperture 30 extends into the bag, thus providing fluid communication from and to an interior 41 of the bag through the chassis to and from the outside of the ink supply. The bag 40 contains in its interior 41 the ink of the ink supply which is supplied to the printer. It is noted here that for ease of illustration, the entire volume of the bag is not shown. The chassis 20 is attached to a shell 50 which contains the bag 40 and protects the bag 40 from punctures and other adverse effects. In an exemplary form as seen in FIGS. 1 and 2, the shell 50 is a flask-like structure with an opening at the top to accept the chassis 20. A flask having a circular or semicircular or square or rectangular cross section or any other convenient cross-section can be used to practice the invention. The shell 50 can provide a gripping area or areas for the user while handling the ink supply. By way of example only and not by way of limitation, the shell may have dimples, knurling, a hat or hats, ribs, studding, protrusions, or other features which will facilitate handling, although the invention can be practiced with a shell having flat or smooth surfaces, or no features at all to facilitate handling. While the embodiment seen in the Figures has a closed bottom, the present invention can be practiced with a shell 50 that has an open bottom, or an opening located at the sides, or multiple openings. In the embodiment of FIGS. 1 and 2, the shell 50 receives a protrusion 23 (third protrusion (second is protrusion discussed below)) of the chassis 20 at the outer periphery 24 of the chassis 20, and holds the chassis 20 in place by a positive retention means such as, by way of example only and not by way of limitation, two ribs 52 and 54 that run along the inside of the shell 50, the ribs collectively holding the chassis in place. Alternatively or in addition to ribs adhesives or an interference fit or indents or a snap fit or any other practical retention means known to one of ordinary skill in the art can be used to secure the chassis 20 to the shell 50. The opening at the top of the shell does not need to be as large as the protrusion 23 defined by the outer periphery 24 of the chassis 20.

In the embodiment of FIG. 1, the chassis 20 is formed of a single integral part, fabricated of polypropylene by injection molding. An integral part has advantages, such as improving the manufacturability and relative locational accuracy of the parts included in and around the chassis. However, the chassis can be formed from two or more parts or by other fabricating methods (by way of example only and not by way of limitation, the chassis 20 can be machined). Further, other material can be used to make the chassis. By way of example only and not by way of limitation, polyethylene is a suitable material to make some or all of the chassis. The chassis 20 of this embodiment has a protrusion 60 (second protrusion), or tower, which protrudes outwardly, although it is envisioned that a chassis can be used without an outward protrusion, or with multiple protrusions, such as is seen in the referenced U.S. Pat. No. 6,017,118. The protrusion 60 in some embodiments may be minimized in height, so that the ink supply 10 is compact, a consideration of ink supplies for desktop printers. The aperture 30 extends through the ink protrusion 60, thus permitting fluid communication through the protrusion 60. In the embodiment of FIG. 1, the protrusion 60 is positioned in the center of the chassis 20. However, the protrusion 60 can be positioned at locations other than the center of the chassis 20. In such instances, the aperture 30, or at least a portion of the aperture 30, may not be positioned in the center of the chassis. The protrusion 60 interfaces with a printer. To this end, the structure of the protrusion 60 may be configured to enhance attachment to the printer.

Alternatively, any other portion of the chassis 20 may be configured to interface with the printer. Alternatively, the shell 50 may be configured to interface with the printer.

Figure 3:
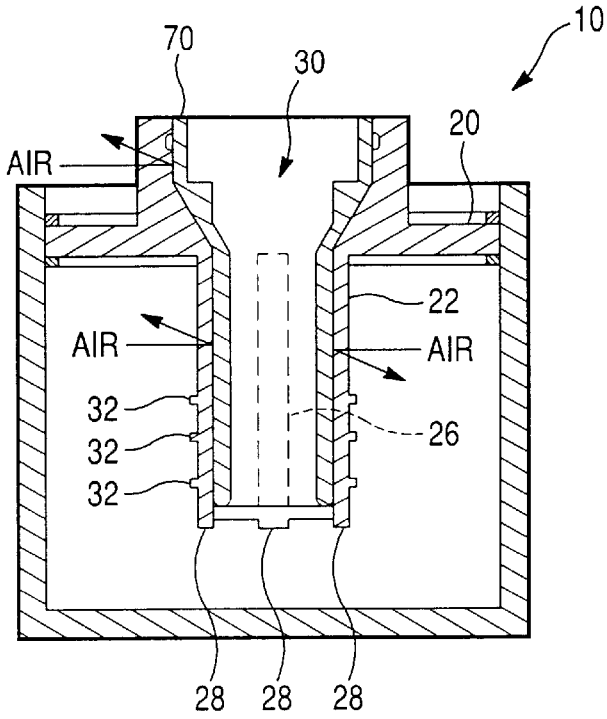
FIG. 3 is a side view of an embodiment of the ink supply of the present invention.

As noted above, in the embodiment of FIG. 1, the chassis 20 has a first protrusion 22 that extends into the bag 40. The protrusion 22 may include a keel portion 26 which extends laterally in one embodiment in the form of wings along an axis from a central core of the protrusion 22. The shape of the keel portion 26 can be more readily seen by comparing FIG. 1 and FIG. 3, where FIG. 3 is a view of the ink supply 10 from the side looking directly down the longitudinal direction of the keel 26. The keel portion 26 provides the sealing or attaching surfaces for connection of the chassis to the collapsible bag 40. The attaching surface allows a volumetrically efficient pleated bag construction to be used for the bag by providing a surface that is substantially parallel to the long axis of the bag. However, it is envisioned that a nonpleated bag can be used to practice the present invention. The lower portion of the keel of one embodiment has a compound curvature partial (number) to prevent concentration of stress should the ink container be dropped. Also, protruding tabs 28 on a portion of a circumference around the inlet to the aperture 30 in the chassis 20 serve to prevent the bag from collapsing and thereby sealing off the inlet of the aperture before all the ink is removed from the reservoir. In an embodiment, the tabs 28 form ridges along the inlet of the aperture 30. Due to the elongation of the keel 26, the sealing surfaces of the bag and keel extend generally parallel, with perhaps a small angular offset, relative to the longitudinal axis of the ink container. It is noted here that other embodiments of the present invention will have keels of varying configuration than that depicted in FIG. 1, and the invention may be practiced without a keel.

Further, the embodiment of FIG. 1 of the present invention comprises ribs 32 extending around at least a portion of the protrusion 22, and/or, on either side of the keel 26. The ribs 32 are located on the protrusion 22 in such a location that some or all of the ribs are contained inside the bag 40 when the bag is attached to the chassis 20. The use of the ribs 32 in the present invention is discussed in more detail below.

In the embodiment of FIG. 1, the bag 40 is collapsible. However, the bag can be rigid or semi-rigid. The bag may be made, at least in part, of material that will bond to at least a portion of the chassis 20 when exposed to heat (although it may be sufficient in some designs to simply adhere the bag to the chassis). This is known in the art as heat staking. By way of example but not by way of limitation, the material of at least a portion of the chassis and the bag material that is to bond with this chassis material may be substantially the same material. By way of example only and not by way of limitation, the bag material that will bond with the chassis material may be polypropylene, polyethylene, or any other suitable material. It is noted that excellent results will be obtained when the material of the chassis that interfaces with the bag is the same material as the material of the bag that interfaces with the chassis.

Referring to the ribs 32 discussed above, the ribs 32 concentrate the heat stake force during the heat staking operation when the bag is attached to the chassis, thus improving the heat stake attachment. The space between the ribs also provides space for molten chassis material to flow during the heat stake.

A feature of the present invention is that the bag 40 is sufficiently resistant to air diffusion to provide a long life of the ink supply. In one embodiment of the present invention, the bag 40 comprises a plurality of layers, and at least one of the layers comprises a metal or metalized layer which is resistant to air diffusion. By way of example only and not by way of limitation, the metal or metalized layer of the bag 40 may be silver or aluminum (by way of example and not by limitation, aluminum foil) although any other suitable material may be used to practice the present invention providing that the material provides for resistance to air diffusion.

In an embodiment, the bag may have a layer of material that comprises either polypropylene or polyethylene (to advance bonding to the chassis), and the bag may also have a layer of material that comprises either silver or aluminum. In some embodiments the bag may have an additional layer of material that comprises either PET or polyamide. The present invention can be practiced with additional layers of other material for the bag, or with fewer layers, or that different materials can be used to form the layers. It is desirable to attach the layers of the bag together, although the present invention can be practiced without attaching the layers of the bag together. This could be accomplished by using an adhesive, although other forms of attachment can be used as well.

Another exemplary embodiment of a bag construction in accordance with an embodiment of the invention is as follows: LLDPE/LLDPE/Nylon//PET/Silver or Aluminum or silicon//Nylon, where "/" represents a coextruded or deposition bond of the layers, and "//" represents an adhesive bond. Other bag structures can also be used, e.g., linear low-density polyethylene (LLDPE)/LLDPE/LLDPE//polyamide (e.g. Nylon)//Aluminum Foil or ethylene vinyl alcohol (EVOH) or Polyvinylidene Chloride copolymer (PVDC)//polyamide.

As noted above, embodiments of the bag 40 may be resistant to air diffusion through the bag and into the ink. However, it is noted here that the material of the chassis, polypropylene or polyethylene, while having desirable manufacturing characteristics, may provide an air diffusion path into the bag, and thus into the ink stored in the bag. That is, air may diffuse through the chassis in the areas of the chassis orthogonal or relatively orthogonal to the aperture 30 (above the bag) and thus into the aperture 30 and then into the ink inside the bag 30.

The embodiment of the present invention shown in FIG. 1 utilizes an air barrier insert 70 to reduce the amount of air that enters the bag via the diffusion path immediately discussed. The air barrier insert 70 of the present invention is configured to fit inside the aperture 30 of the chassis 20 and cover the inner peripheral walls of the aperture 30 for a portion or for the entire length of the aperture 30 so that ink can pass therethrough via an aperture 78 in the air barrier insert. The principal of operation of the air barrier can be seen in FIG. 3, which shows a hypothetical air path in a simplified ink supply 10. In the first embodiment, the air barrier insert extends from at least the top of the protrusion 60 into the bag 40 a sufficient distance such that the air diffusion into the aperture 30 is negligible. In another embodiment, the air barrier may extend completely through the aperture. However, additionally the air barrier insert may extend beyond the top of the protrusion 60 or start below the top of the protrusion 60, or extend only part way down into the aperture 30. In one exemplary embodiment, the air barrier is made from PEI (eg. polyetherimide, e.g. Ultem) In another exemplary embodiment, the air barrier insert is made from steel. By way of example only and not by way of limitation, the air barrier insert can be made of stainless steel, although other steel types can be used. Alternative embodiments can utilize inserts made from other metals, ceramics and high air barrier polymers, and other materials that will provide a suitable barrier to air diffusion. Additional alternative embodiments can utilize air barriers made from PET, PA, ABS, PPS, LCP, EVOH, and other similar materials.

In one embodiment of the present invention, the air barrier insert 70 may be interference fitted into the aperture 30, although other embodiments of the air barrier insert may be adhesively bonded into the aperture, while still other embodiments the insert may be positively retained in the aperture. The interference fit is accomplished by pressing the air barrier insert 70 into the aperture 30 in the chassis 20, although it is possible that the air barrier insert 70 can be pressed into the chassis 20 without forming an interference fit and instead forming a slip fit or a clearance fit. As is readily apparent from FIG. 1, the air barrier insert of the first embodiment has a larger outside diameter at the top than at the bottom. This diameter difference has the beneficial effect of preventing the air barrier insert from sliding down the aperture 30 and into the bag 40. Additionally, the air barrier insert 70 of the embodiment of FIG. 1 has a relatively constant wall thickness, thus translating to a larger inside diameter at the top of the insert than at the bottom of the insert, although a constant or relatively constant wall thickness is not necessary to practice the present invention. It is further noted that the present invention can be practiced with a cylindrical air barrier resembling a tube. Other embodiments of the air barrier insert may utilize a cylindrical air barrier resembling a tube with a flange, or hat, on the top portion, thus preventing the air barrier from sliding down into the bag. With this in mind, it can be seen from FIG. 1 that the inside surface of the insert does not always parallel the outer surface of the insert 70. FIG. 1 shows that the insert 70 of the present invention having a surface 72 to support a septum 80 (discussed below), which is positioned in a space 74 of the air barrier insert 70. The present invention can be practiced with air barrier inserts having a wide variety of configurations. Some or all of the exterior surfaces of the insert 70 may match the surfaces of the aperture 30. Alternatively, air barrier inserts 70 that do not interface with the surface of the aperture 30 can be used to practice the present invention. In such instances, O-rings or other sealing devices can be placed in between the insert 70 and the chassis 20 at various locations, thus preventing air from entering into the bag via spaces between the insert 70 and the chassis 20. The embodiment of FIG. 1 utilizes an O-ring 76. By way of example only and not by way of limitation, it the O-ring 76 is positioned in an annular indent 34 in the chassis 20 in the protrusion 60, although the O-ring can be placed at other positions as well, or that multiple O-rings can be utilized, or that the gap 34 be in the insert 70 (the walls of space 74 being smooth), or that gap 34 extend in both the insert 70 and the protrusion 60. However, O-rings are not necessary to practice the present invention. Also, it is envisioned that other sealing devices can be used to prevent air from traveling into the bag via a space in between the insert 70 and the chassis 20. Additionally, the chassis configuration can be produced whereby a gap 34 is not present when using an O-ring. By way of example and not by limitation, if the insert 70 and the aperture 30 are formed so that there is a surface on the insert 70 and a surface on the aperture 30 that are normal or about normal to the vertical walls of the insert 70 and the vertical walls aperture 30, respectively, an O-ring can be positioned in between or close to those surfaces without a gap for the O-ring.

Figure 4:
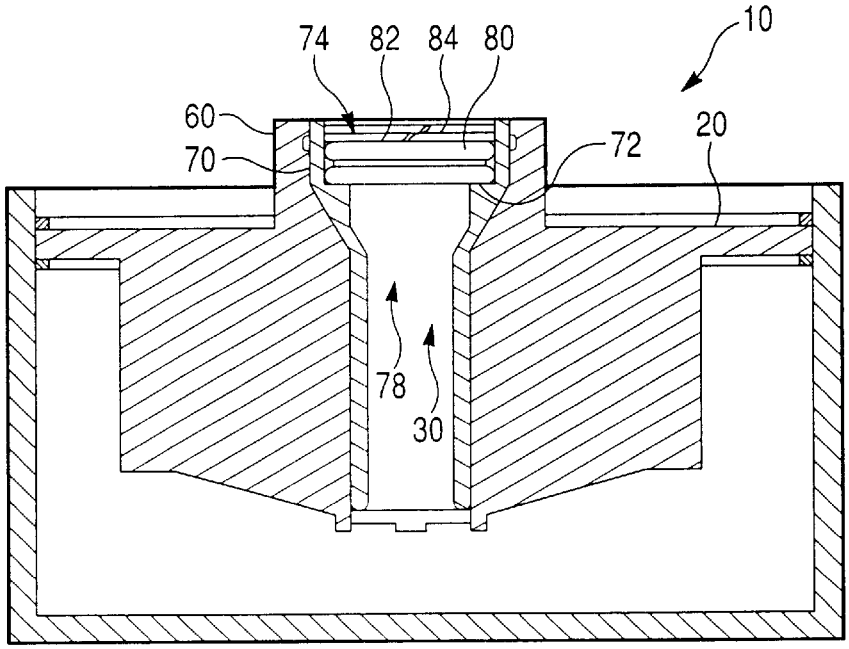
FIG. 4 is a schematic diagram showing the septum and a septum retention element of one embodiment of the ink supply of the present invention.
Figure 5:
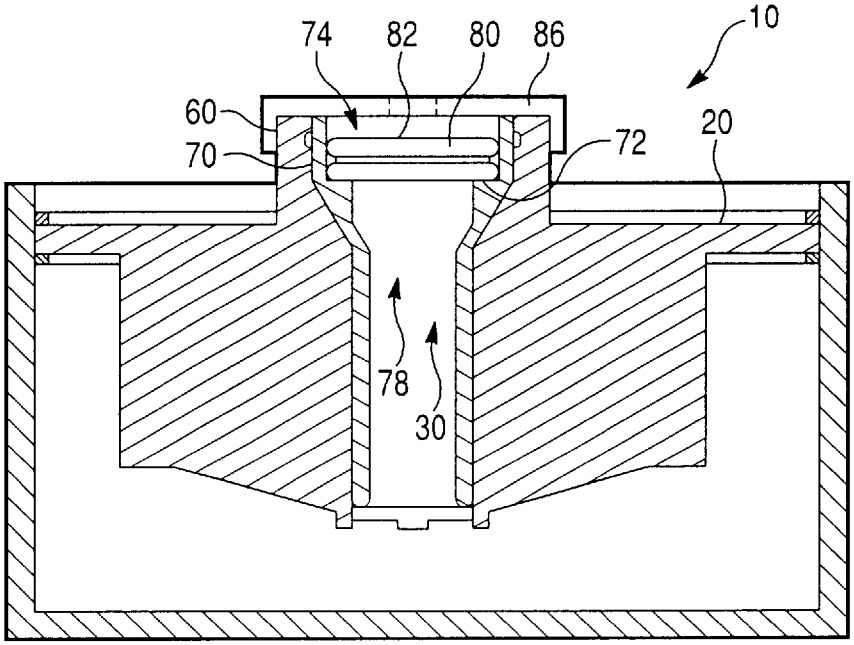
FIG. 5 is a schematic diagram showing the septum and a septum retention element of an alternative embodiment of the ink supply of the present invention.
Figure 6:
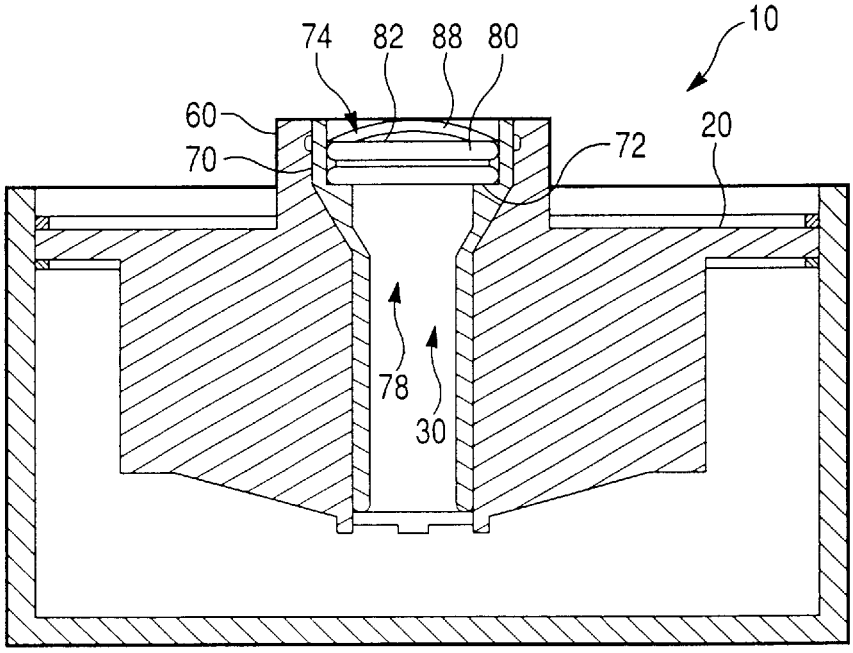
FIG. 6 is a schematic diagram showing the septum and a septum retention element of an alternative embodiment of the ink supply of the present invention.

As noted above, embodiments of the invention may include a septum 80 positioned inside the air barrier insert 70. The septum 80, which is seen in FIGS. 4–7, is used to prevent air from entering into the bag 40 through the aperture 78 of the air barrier insert 70. However, the septum 80 may be configured to permit a needle from a desk top printer to pierce the septum at an angle normal or substantially normal to the upper surface 82 of the septum 80, while still preventing air from entering through or around the septum while the needle is piercing the septum or after the needle is withdrawn from the septum. By way of example only and not by way of limitation, the septum 80 can have a slit in the septum to accept a needle, although it is envisioned that invention can be practiced with a septum 80 that does not have a slit. By way of example but not by way of limitation, the septum 80 may be made of isoprene rubber. While the septum 80 of the embodiment of FIG. 4 is positioned inside the insert 70 to form either or both a radial seal on the horizontal surface of the space 74 or an axial seal on surface 72, alternatively, the septum 80 may be positioned on the outside of the insert 70, thus forming an axial seal. This latter configuration may be applicable, by way of example and not by way of limitation, in embodiments where the insert does not extend all the way up to the end of the protrusion 60. That is, the end of the air barrier insert 70 would be positioned against the bottom surface of the septum 80. The septum 80 may be interference fitted into space 74 of the insert (or into the aperture of the chassis in other embodiments). However, other embodiments may be implemented where the septum is adhesively bonded to the air barrier insert (or to the aperture of the chassis in other embodiments). Still further embodiments may positively retain the septum inside the insert (or inside the aperture of the chassis in other embodiments). By way of example only and not by way of limitation, a lock ring 84 shown in FIG. 4, or a cap 86 shown in FIG. 5, or a washer 88 with wings, where the wings dig into the sides of the insert 70 or chassis 20 shown in FIG. 6, could be used to secure the septum 80 to the insert 70. Additionally or alternatively, the septum 80 may provide ink containment for the ink supply 10, even after a needle from a printer pierces the septum. Still, other embodiments of the present invention are envisioned whereby a septum 80 is not utilized. By way of example only and not by way of limitation, the components of the printer that interface with the ink supply could have a device that prevents air from entering the bag 40 via the insert 70. However, it is noted that the ink supply 10 still requires a component which will prevent air from flowing into the bag 40 or ink from flowing out of the bag 40. Such a device is described below.

Figure 7:
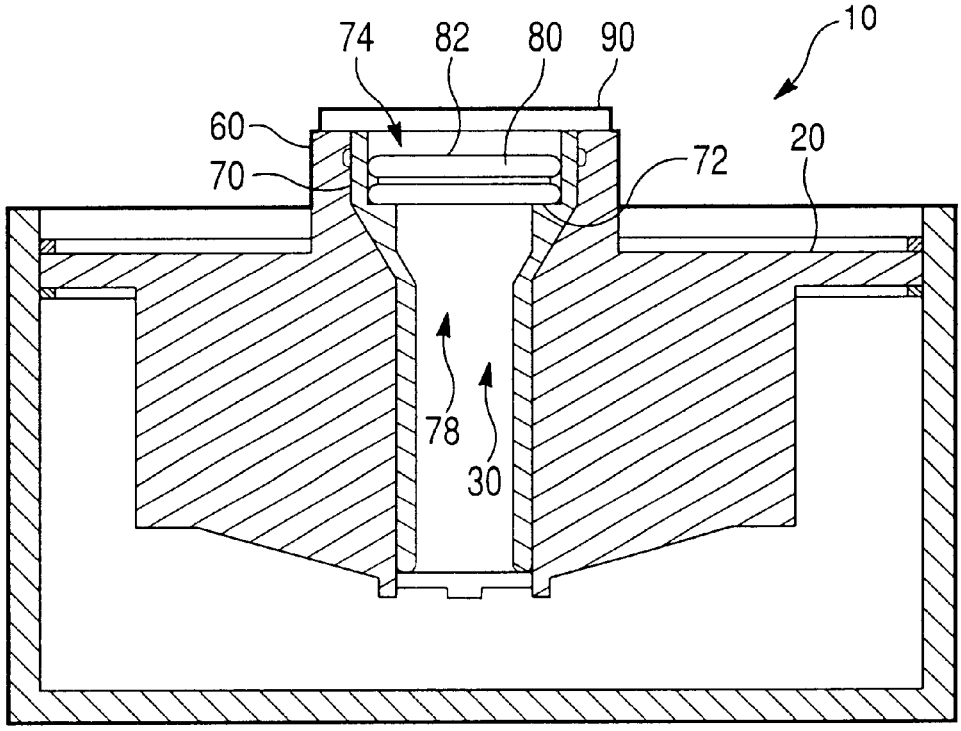
FIG. 7 is a schematic diagram showing the location of the foil film of an embodiment of the ink supply of the present invention.

The ink supply 10 of a further embodiment comprises a film 90 positioned over the top opening of the aperture 30 of chassis 20 in a manner that it blocks the aperture 30, as is seen in FIG. 7. The film 90 is made from material that is resistant to air diffusion. In one embodiment, at least a portion of film 90 is made from material that will bond with the material of at least a portion of the chassis 20 when exposed to heat in a manner similar to or the same as that described above regarding the bond between the bag 40 and the chassis 20. Indeed, the material of the film 90 may be the same as the material of the bag 40, although additional embodiments are possible where the material is different than the material of the bag. The film 90 may be staked to the chassis 20 in a similar or in the same manner that the bag 40 is staked to the chassis 20. In one embodiment of the present invention, the film is staked to the top of the protrusion 60, while in other embodiments the film is staked to the side of the protrusion 60 (in these embodiments, the film extends past the edges of the top of the protrusion 60 and around to the sides of the protrusion 60), while in still other embodiments, it is staked in both locations.

In an embodiment of the present invention, the film 90 may comprises a plurality of layers, and at least one of the layers comprises a metal or metalized layer which is resistant to air diffusion. By way of example only and not by way of limitation, the metal or metalized layer of the film 90 may be silver or aluminum or aluminum foil, or any other suitable material that provides resistance to air diffusion.

Figure 8:
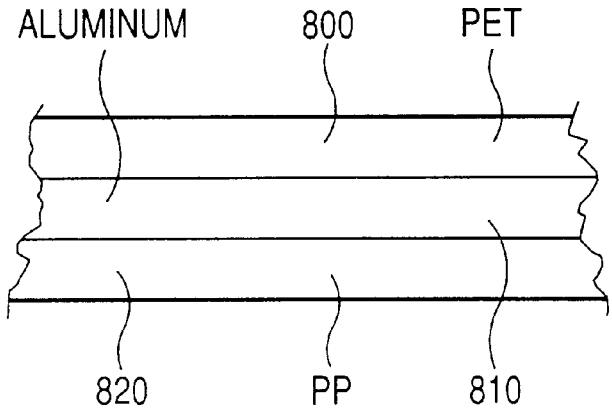
FIG. 8 is a schematic diagram showing the cross-section of the foil of an embodiment of the ink supply of the present invention.

By way of example and not by way of limitation, the film may have a layer of material that comprises either polypropylene or polyethylene, and the film may also have a layer of material that comprises either silver or aluminum. The film may have an additional layer of material that comprises either PET or polyamide. FIG. 8 shows a cross-sectional view of the film of one possible embodiment of the present invention comprising a layer 800 of PET, a layer 810 of aluminum, and a layer 820 of PP. The present invention can be practiced with additional layers of other material as well, or with fewer layers, or that different materials can be used to form the layers. Additionally, it may be desirable to attach the layers of the film together. This could be accomplished by using an adhesive, although other forms of attachment can be used as well. The film 90 may be adapted to be readily pierced by a hollow needle from a printer.

Figure 13:
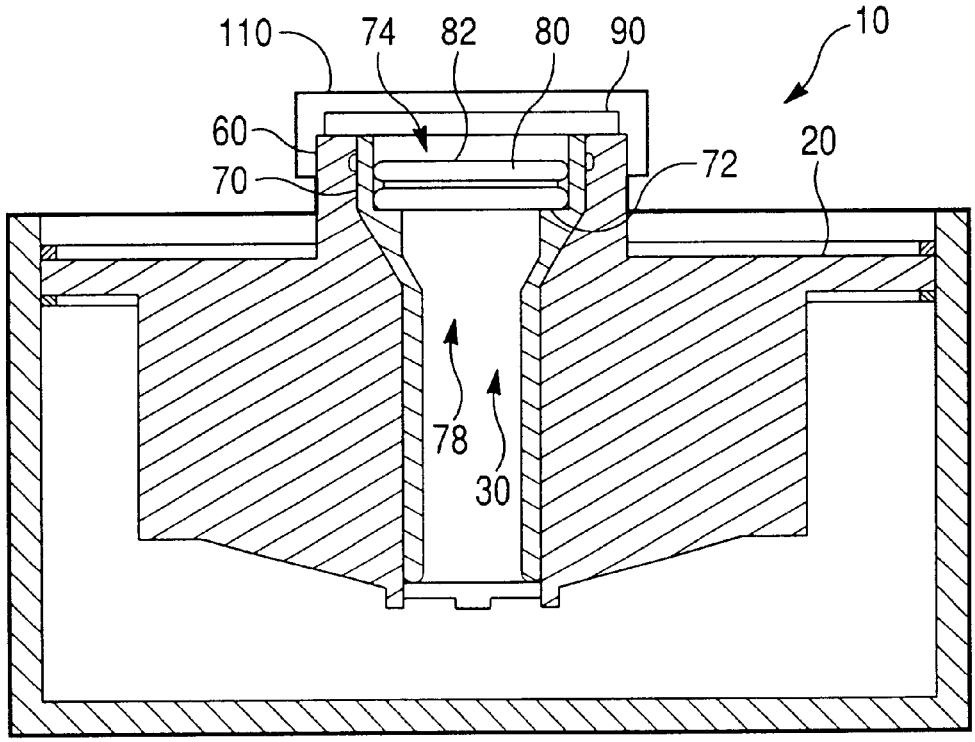
FIG. 13 is a sectional view of the air barrier inside the chassis of an alternate embodiment of the ink supply of the present invention with a cap.

Another exemplary embodiment of a film construction is as follows: LLDPE/LLDPE/Nylon//PET/Silver or Aluminum or silicon//Nylon, where "/" represents a coextruded or deposition bond of the layers, and "//" represents an adhesive bond. Other bag structures can also be used, e.g., linear low-density polyethylene (LLDPE)/LLDPE/LLDPE//polyamide (e.g. Nylon)//Aluminum Foil or ethylene vinyl alcohol (EVOH) or Polyvinylidene Chloride copolymer (PVDC)//polyamide In one embodiment of the invention, a cap 110, shown in FIG. 13, may be provided which protects the film 90 from accidental puncture prior to use of the ink supply. The cap may serve as an air barrier as well, especially after the film 90 is punctured. The cap may be attached to the protrusion 60 by screws, snaps, or other convenient attachment methods.

Figure 9:
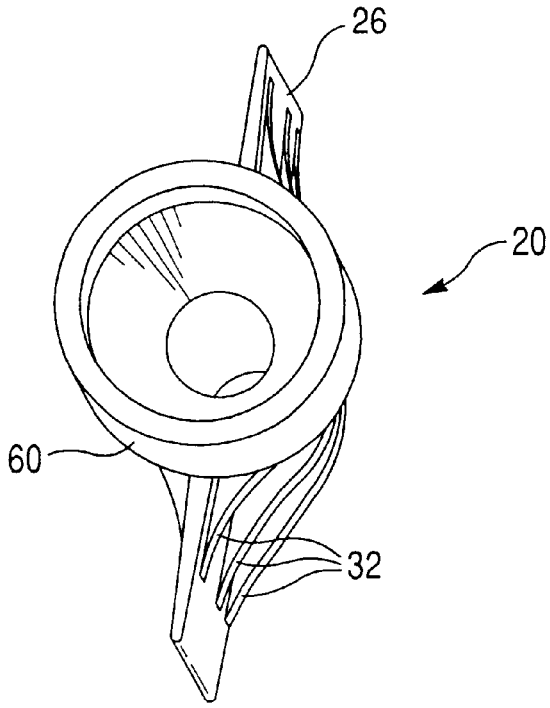
FIG. 9 is a partial perspective view of the chassis of an embodiment of the ink supply of the present invention with the third protrusion of the chassis not shown.

FIGS. 9–12 show alternate embodiments of the present invention, focusing on the chassis and the air barrier. FIG. 9 is a partial perspective view of the chassis 20, with keel 26, protrusion 60, and ribs 31 of an alternate embodiment of the ink supply of the present invention, with the protrusion 23 of the chassis (the protrusion forming the outer periphery 24 of the chassis) not shown.

Figure 10:
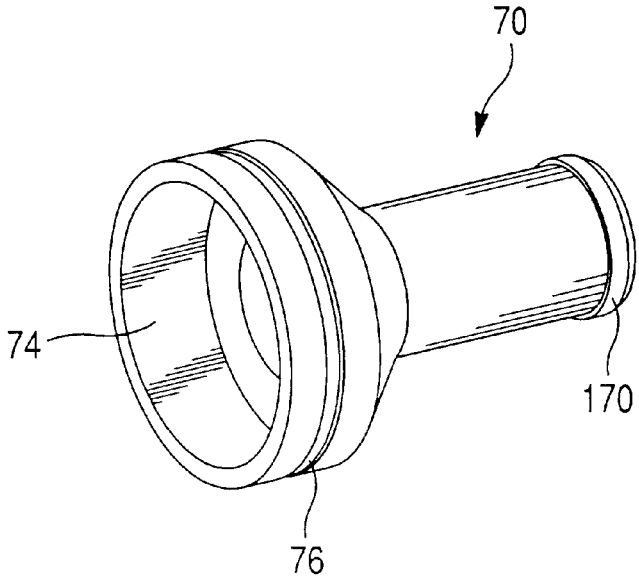
FIG. 10 is a partial perspective view of the air barrier of an alternate embodiment of the ink supply of the present invention.

FIG. 10 is a perspective view of the air barrier 70 of one embodiment of the ink supply of the present invention, showing space 74 and O-ring 76.

In FIG. 10, a rim 170 can be seen on the air barrier insert 70. The rim 170 is provided to further secure the insert inside the chassis 20. In such an embodiment, the rim 170 would form an interference fit on the inside of the aperture 30 of the chassis 20. However, in embodiments of the insert where the end of the insert extends past the chassis 20, the rim 170 would simply interface with the bottom of the chassis 20. The rim 170 may provide accuracy and stability at the end of the insert 70 when the exterior of the insert does not exactly match the aperture 30 of the chassis 20.

Figure 11:
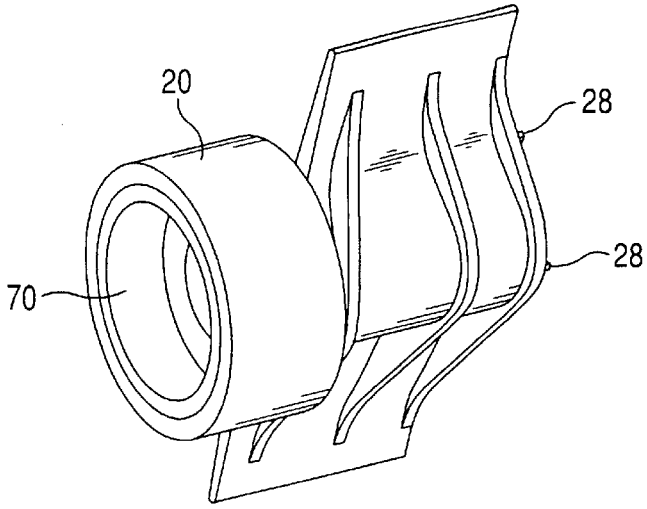
FIG. 11 is a partial perspective view of the air barrier inside the chassis of an alternate embodiment of the ink supply of the present invention with the third protrusion of the chassis not shown.
Figure 12:
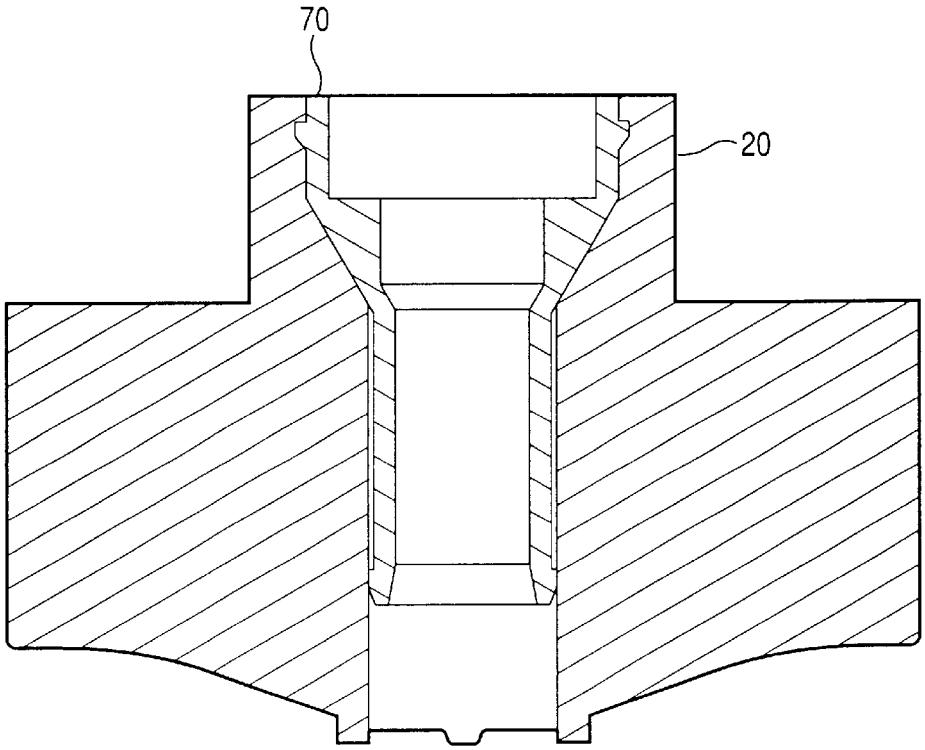
FIG. 12 is a sectional view of the air barrier inside the chassis of an alternate embodiment of the ink supply of the present invention with the third protrusion of the chassis not shown.

FIG. 11 is a partial perspective view of the chassis 20 and air barrier 70 with the air barrier 70 inside the chassis 20 of an alternate embodiment of the ink supply of the present invention with the protrusion 23 of the chassis not shown. FIG. 12 is a sectional view of the air barrier 70 inside the chassis 20 of one embodiment of the ink supply of the present invention with the protrusion 23 of the chassis not shown.

Embodiments of the present invention may be implemented to provide an ink supply that are compact and can be manufactured for a relatively low cost, thus allowing the ink supply to be used in desk top printers. While various configurations of embodiments of the present invention are seen schematically in the Figures, it is envisioned that other configurations of ink supplies can be produced and used in reliance upon the teachings of this application. By way of example only and not by way of limitation, it is envisioned that the present invention can be practiced with a protrusion 22 that does not extend as far into the bag as seen in the Figures. Indeed, it is noted here that the Figures. are provided for conceptual purposes only, and that the present invention is not limited to any dimension inferred or implied by the Figures.

The capacity of various embodiments of the present invention may include ink supplies capable of holding an amount of ink at a value anywhere from less than 5 cc to more than 100 cc of ink, and values therebetween. By way of example only and not by way of limitation, it is envisioned that one embodiment of the present invention can hold 7 cc of ink, while another embodiment can hold 50 cc of ink, while another can hold 98 cc of ink. The dimensions of various embodiments of the present invention include ink supplies having shipping cube dimensions of less than 0.5 cm to greater than 3 cm in width, less than 1.0 cm to greater than 8.0 cm in length, and less than 2.0 cm to greater than 8.0 cm in height. By way of example only and not by way of limitation, it is envisioned that one embodiment of the present invention can have the dimensions 1.0 cm in width, 5.0 cm in length, and 5 cm in height, while another embodiment may have the dimensions 3 cm in width, 8 cm in length, and 5 cm in height. It is noted here that the present invention is not limited to the just mentioned dimensions and capacities. It is envisioned that the present invention can be practiced with an ink supply having less than or greater than the dimensions and capacities just mentioned.

After the above components are assembled, with the exception of the film 90 and/or the septum 80, the ink supply can be flushed with $CO_2$ and then filled with degassed ink. After filling the supply with ink, the septum is inserted into the barrier 70 and then the film 90 is staked over the opening of the aperture 30, thus closing off the primary air path.

Some or all of the embodiments of the present invention just described may be used to ensure that the air solubility level of the ink inside the bag in a properly sealed ink supply does not exceed 70% for at least 6 months after ink is introduced into the bag and the ink supply is sealed. It is envisioned that possibly some or all of the embodiments of the present invention just described may be designated to ensure that the air solubility level of the ink inside the bag in a properly sealed ink supply does not exceed 70% for at least 18 months after ink is introduced into the bag and the ink supply is sealed. Some or all of the embodiments of the present invention just described may be designed to ensure that the air solubility level of the ink inside the bag of a properly sealed ink supply does not exceed 70% for at least 30 months after ink is introduced into the bag and the ink supply is sealed. It is envisioned that possibly some or all of the embodiments of the present invention just described will ensure that if 15 cc of ink is placed inside the bag of a properly sealed ink supply, the transmission rate for the ink supply will be less than 0.001 cc of air per day at 35° C. after the ink supply is sealed. Further by way of example only and not by way of limitation, it is envisioned that if one or more of the embodiments of the invention just described is practiced, and the portion of the chassis exposed to air has an 9 millimeter inside diameter, a 1 millimeter wall thickness, is 5 millimeters high, and is made from a material having an air permeability of <18 cc-mil/100 $in^2$-atm-day, the just described performance levels can be achieved. However, it is envisioned that the present invention can be practiced through some or all of the embodiments of the present invention just described without attaining the performance levels just described or surpassing the performance levels just described.

The foregoing descriptions of the embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink supply for a printing system comprising:

a chassis with at least one aperture extending therethrough;

a bag comprising material that is resistant to air diffusion, wherein the bag is attached to the chassis to allow ink communication from the bag through the aperture in the chassis; and at least one air barrier insert with an aperture therethrough positioned in the at least one aperture of the chassis.

2. The ink supply of claim 1, wherein the chassis further comprises:

at least one protrusion;

wherein the aperture of the chassis is located in the protrusion, and wherein the bag is attached to the chassis on the protrusion so that at least a portion of the protrusion extends into the bag.

3. The ink supply of claim 2, wherein at least a portion of the bag comprises material that will bond with material of at least a portion of the chassis when the material of the bag is in contact with the at least a portion of the chassis and is exposed to heat.

4. The ink supply of claim 3, wherein the material of at least a portion of the chassis and the bag material that will bond with the chassis material is substantially the same material.

5. The ink supply of claim 4, wherein the bag material that will bond with the chassis material is polypropylene.

6. The ink supply of claim 5, wherein the bag further comprises a plurality of layers, at least one layer comprising a metal or metalized layer and being resistant to air diffusion.

7. The ink supply of claim 6, wherein the metal or metalized layer is material selected from the group consisting of silver and aluminum.

8. The ink supply of claim 4, wherein the bag material that will bond with the chassis material is polyethylene.

9. The ink supply of claim 8, wherein the bag further comprises a plurality of layers, at least one layer comprising a metal or metalized layer and being resistant to air diffusion.

10. The ink supply of claim 9, wherein the metailzed layer is a material selected from the group consisting of silver and aluminum.

11. The ink supply of claim 2, further comprising a shell, wherein the shell extends around at least a portion of the bag.

12. The ink supply of claim 1, wherein the bag comprises:

a layer of material selected from the group consisting of polypropylene and polyethylene; and a layer of material selected from the group consisting of silver and aluminum.

13. The ink supply of claim 12, wherein the bag further comprises a layer of material selected from the group consisting of PET and PA.

14. The ink supply of claim 1, wherein the air barrier insert extends into the bag.

15. The ink supply of claim 1, wherein the air barrier insert extends completely through the aperture.

16. The ink supply of claim 1, wherein the air barrier insert is entirely contained inside the aperture.

17. The ink supply of claim 1, wherein at least a portion of the air barrier insert is made of a material selected from the group consisting of metal, ceramic, and a high air barrier polymer.

18. The ink supply of claim 1, wherein at least a portion of the air barrier insert is made of stainless steel.

19. The ink supply of claim 1, wherein at least a portion of the air barrier insert is made of a material selected from the group consisting of PA, PET, ABS, PPS, LCP, EVOH, and PEI.

20. The ink supply of claim 1, wherein at least a portion of the air barrier insert is made of material that is resistant to air diffusion.

21. The ink supply of claim 1, wherein at least a portion of the air barrier insert is made from PEI.

22. The ink supply of claim 1, wherein the air diffusion barrier is interference fitted into the aperture.

23. The ink supply of claim 1, wherein the air diffusion barrier is adhesively bonded into the aperture.

24. The ink supply of claim 1, wherein the air diffusion barrier is positively retained in the aperture.

25. The ink supply of claim 1, further comprising an O-ring, positioned between the air barrier and the chassis.

26. The ink supply of claim 1, further comprising a septum located at an entrance of the aperture.

27. The ink supply of claim 26, wherein the septum is located in the air barrier.

28. The ink supply of claim 27, wherein the septum is interference fitted in the air barrier.

29. The ink supply of claim 27, wherein the septum is adhesively bonded to the air barrier.

30. The ink supply of claim 27, wherein the septum is positively retained in the air barrier.

31. The ink supply of claim 30, wherein positive retention of the septum is provided by at least one element selected from the group consisting of a washer, a cap, and a lock ring.

32. The ink supply of claim 27, wherein the air barrier comprises a first section that is of different diameter than at least one other section of the air barrier, and wherein the septum is located in the first section.

33. The ink supply of claim 27, wherein the septum forms a radial seal to provide ink and air containment.

34. The ink supply of claim 26, wherein the septum provides ink containment and serves as an air barrier.

35. The ink supply of claim 26, wherein the septum is made from isoprene.

36. The ink supply of claim 1, further comprising a film blocking the aperture, wherein the film is made from material that resists air diffusion.

37. The ink supply of claim 36, wherein at least a portion of the film comprises material that will bond with the material of at least a portion of the chassis when the material is in contact with the chassis and is exposed to heat.

38. The ink supply of claim 37, wherein the material of at least a portion of the chassis and the film material that will bond with the chassis material is substantially the same material.

39. The ink supply of claim 38, wherein the film material that will bond with the chassis material is polypropylene or polyethylene.

40. The ink supply of claim 34, wherein the film further comprises a plurality of layers, at least one layer comprising a metalized layer and being resistant to air diffusion.

41. The ink supply of claim 40, wherein the metalized layer is material selected from the group consisting of silver and aluminum.

42. The ink supply of claim 36, wherein the film comprises:

a layer of material selected from the group consisting of polypropylene and polyethylene; and a layer of material selected from the group consisting of silver and aluminum.

43. The ink supply of claim 42, wherein the film further comprises a layer of material selected from the group consisting of PET and PA.

44. The ink supply of claim 36, wherein the film is adapted to be pierced by a hollow needle.

45. The ink supply of claim 1, further comprising a supply cap.

46. An ink supply for a printing system comprising:

a chassis, wherein the chassis comprises first and second protrusions, and wherein an aperture extends through each of the protrusions to allow fluid communication therethrough;

a bag, wherein the bag is attached to the chassis so that at least a portion of the first protrusion is surrounded by the bag;

at least one air barrier insert, wherein the air barrier insert is located in the aperture;

a septum, wherein the septum is located in the air barrier;

a film, wherein the film is attached to the second protrusion and covers the aperture in the protrusion; and a shell, wherein the shell extends around at least a portion of the bag.

47. The ink supply of claim 46, wherein at least a portion of the air barrier insert extends into the bag.

48. The ink supply of claim 46, further comprising a third protrusion positioned between the first and second protrusions and extending substantially perpendicular thereto, wherein the aperture extends through the third protrusion to allow fluid communication, and wherein the shell is connected to the third protrusion.

49. The ink supply of claim 46, wherein the first protrusion is substantially aligned with the second protrusion.

50. The ink supply of claim 46, wherein the ink supply is constructed so that the air solubility level of ink inside the bag does not exceed 70% for at least 6 months after ink is introduced into the bag and the ink supply is sealed.

51. The ink supply of claim 46, wherein the ink supply is constructed so that the air solubility level of ink inside the bag does not exceed 70% for at least 18 months after ink is introduced into the bag and the ink supply is sealed.

52. The ink supply of claim 46, wherein the ink supply is constructed so that air solubility level of ink inside the bag does not exceed 70% for at least 30 months after ink is introduced into the bag and the ink supply is sealed.

53. The ink supply of claim 46, wherein the ink supply is constructed so that if 15 cc of ink is placed inside the bag, the transmission rate for the ink supply will be less than 0.001 cc per day at 35° C. after the ink supply is sealed.

54. A printer, comprising:

an ink supply station comprising a needle, adapted to interface with a replaceable ink supply, wherein the ink supply comprises:

a chassis, wherein the chassis comprises first and second protrusions, and wherein an aperture extends through each of the protrusions to allow fluid communication therethrough;

a bag, wherein the bag is attached to the chassis so that at least a portion of the first protrusion is surrounded by the bag;

at least one air barrier insert, wherein the air barrier insert is located in the aperture;

a septum, wherein the septum is located in the air barrier;

a film, wherein the film is attached to the second protrusion and covers the aperture in the protrusion; and a shell, wherein the shell extends around at least a portion of the bag.

55. A method of making ink supply comprising:

attaching a chassis to a bag for containing ink, wherein the chassis comprises a first and second protrusion, and wherein an aperture extends through each of the protrusions to allow fluid communication, and wherein the bag is attached to the chassis so that at least a portion of the first protrusion is surrounded by the bag;

inserting at least one air barrier insert into the chassis, wherein the air barrier insert is inserted in the aperture;

inserting a septum into the air barrier;

attaching a film to the second protrusion so that the film covers the aperture in the protrusion; and attaching a shell to the chassis so that the shell extends around at least a portion of the bag.

* * * * *